US008794272B1

(12) United States Patent
Foley et al.

(10) Patent No.: US 8,794,272 B1
(45) Date of Patent: Aug. 5, 2014

(54) GRANULAR FILLER TRANSFER DEVICE

(76) Inventors: Karen L. Foley, Glebe (AU); David Darryl Roberts, Glebe (AU)

( * ) Notice: Subject to any disclaimer, the term of this patent is extended or adjusted under 35 U.S.C. 154(b) by 270 days.

(21) Appl. No.: 13/356,783

(22) Filed: Jan. 24, 2012

(51) Int. Cl.
*B67C 11/02* (2006.01)

(52) U.S. Cl.
CPC ..... *B67C 11/02* (2013.01)
USPC ..... 141/10; 141/114; 141/316; 141/332

(58) Field of Classification Search
CPC ..... B67C 11/00; B67C 11/02; B67C 11/04
USPC ..... 141/10, 313–314, 316, 331–345, 114
See application file for complete search history.

(56) References Cited

U.S. PATENT DOCUMENTS

| | | | | |
|---|---|---|---|---|
| 1,088,633 | A | 2/1914 | Boyer et al. | |
| 1,290,405 | A * | 1/1919 | Suter | 248/101 |
| 4,020,922 | A * | 5/1977 | Klasel | 184/1.5 |
| 4,133,356 | A | 1/1979 | Dillingham | |
| 4,248,278 | A | 2/1981 | Blodgett | |
| 4,485,855 | A * | 12/1984 | Dillingham | 141/316 |
| 4,698,861 | A * | 10/1987 | Bogusz | 4/654 |
| 5,379,810 | A | 1/1995 | Marino | |
| D360,510 | S | 7/1995 | Slovak | |
| 5,848,625 | A * | 12/1998 | Ebert | 141/246 |
| 5,871,037 | A | 2/1999 | Feldt | |
| 5,918,651 | A | 7/1999 | Gazdy et al. | |
| 6,035,908 | A * | 3/2000 | Hoffmann | 141/331 |
| 6,068,031 | A | 5/2000 | Lataix et al. | |
| 6,105,640 | A | 8/2000 | Holand et al. | |
| 8,397,769 | B2 * | 3/2013 | Catelli | 141/114 |

FOREIGN PATENT DOCUMENTS

| | | | |
|---|---|---|---|
| WO | WO2010/119476 | * 10/2010 | F16L 11/118 |

* cited by examiner

*Primary Examiner* — Gregory Huson
*Assistant Examiner* — Nicolas A Arnett

(57) ABSTRACT

A granular filler transfer device is provided for transferring granular fill material from a source container into a destination container. The device includes a tubular member having a first end portion flared outwardly approaching a first end of the tubular member and a second end portion flared outwardly approaching a second end of the tubular member. A first strap is removably coupled to the tubular member proximate the first end portion. The first strap is configured for securing around an opening of a source container holding a granular filler material. A second strap is removably coupled to the tubular member and positioned proximate the second end portion. The second strap is configured for securing around an aperture of a destination container.

9 Claims, 5 Drawing Sheets

GRANULAR FILLER TRANSFER DEVICE

BACKGROUND OF THE DISCLOSURE

Field of the Disclosure

The disclosure relates to funnel devices and more particularly pertains to a new funnel device for transferring granular fill material from a flexible source container into a flexible destination container.

SUMMARY OF THE DISCLOSURE

An embodiment of the disclosure meets the needs presented above by generally comprising a tubular member having a first end portion flared outwardly approaching a first end of the tubular member and a second end portion flared outwardly approaching a second end of the tubular member. A first strap is removably coupled to the tubular member proximate the first end portion. The first strap is configured for securing around an opening of a source container holding a granular filler material. A second strap is removably coupled to the tubular member and positioned proximate the second end portion. The second strap is configured for securing around an aperture of a destination container.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
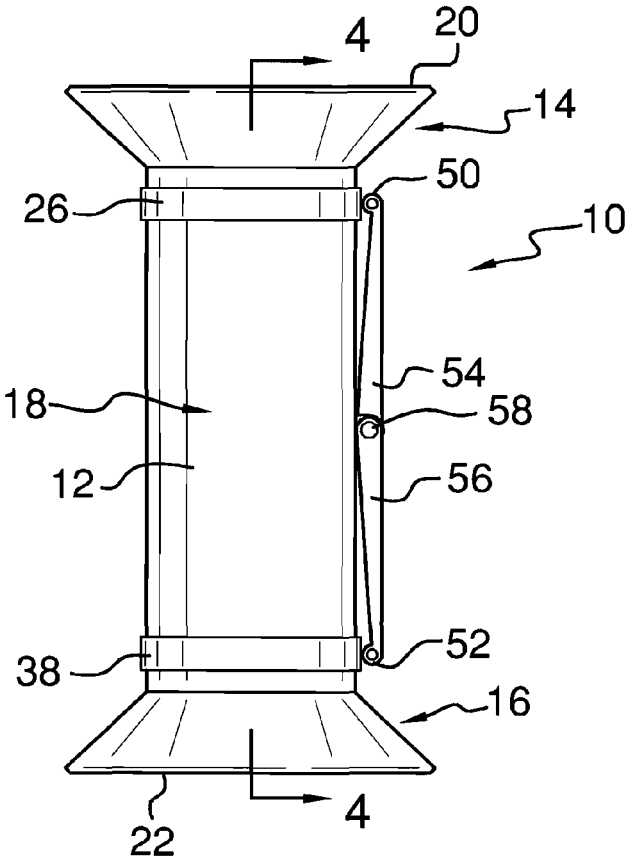
FIG. 1 is a front view of a granular filler transfer device according to an embodiment of the disclosure.
Figure 2:
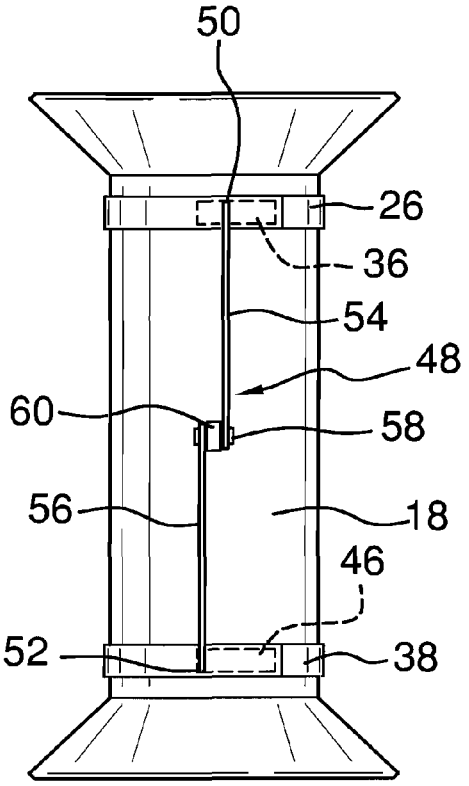
FIG. 2 is a side view of an embodiment of the disclosure.
Figure 3:
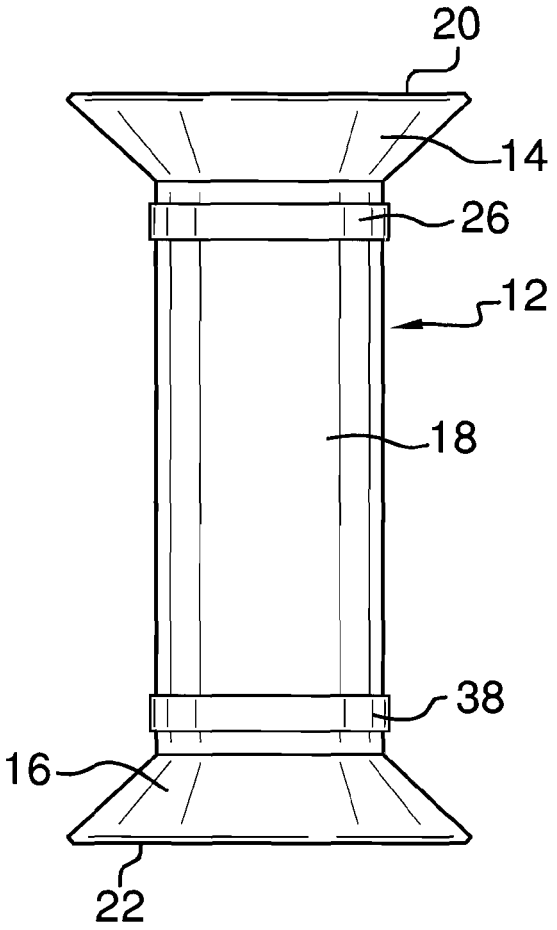
FIG. 3 is a side view of an embodiment of the disclosure.
Figure 4:
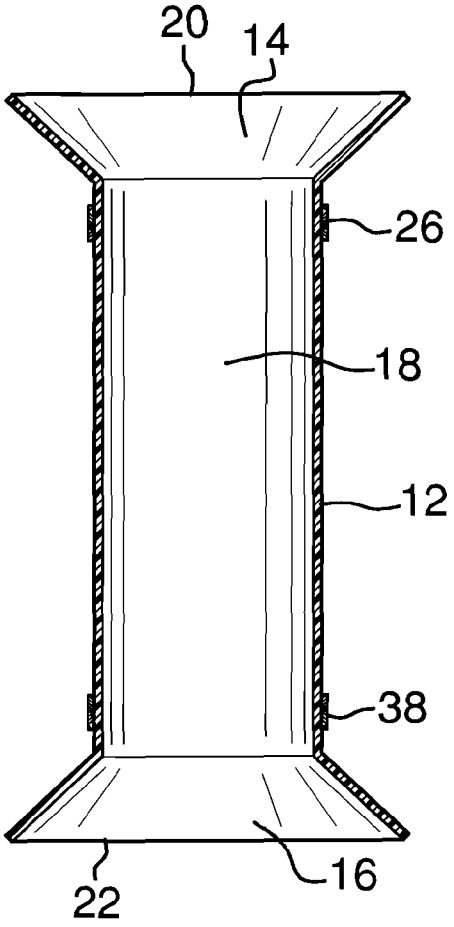
FIG. 4 is a cross-sectional view of an embodiment of the disclosure taken along line 4-4 of FIG. 1.
Figure 5:
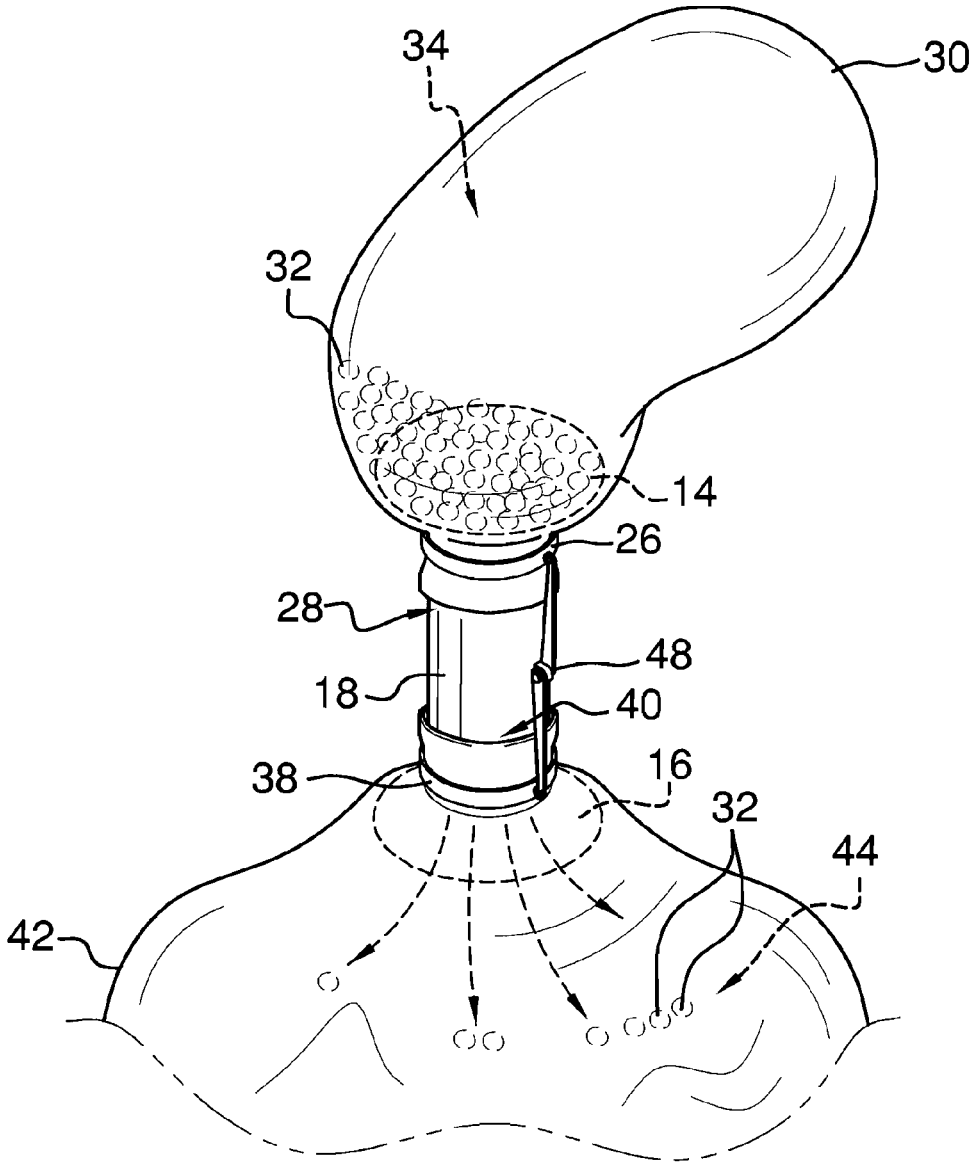
FIG. 5 is a top front side perspective view of an embodiment of the disclosure in use.
Figure 6:
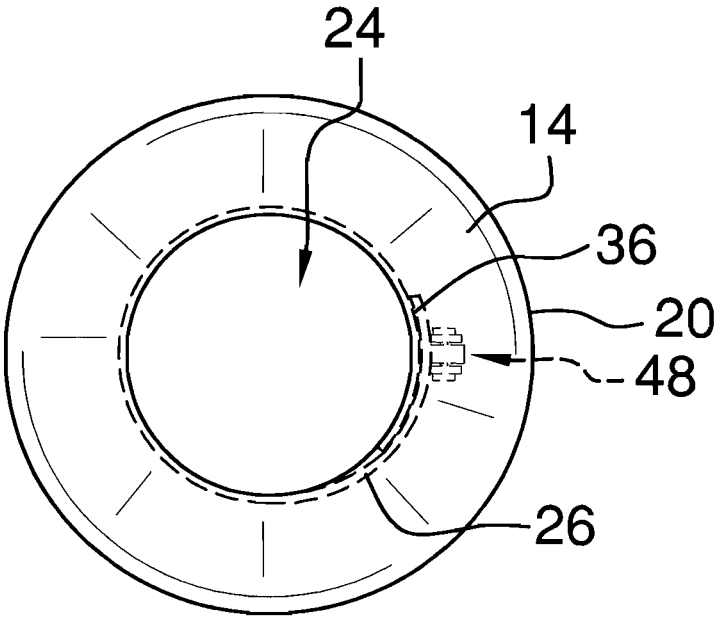
FIG. 6 is a top view of an embodiment of the disclosure.
Figure 7:
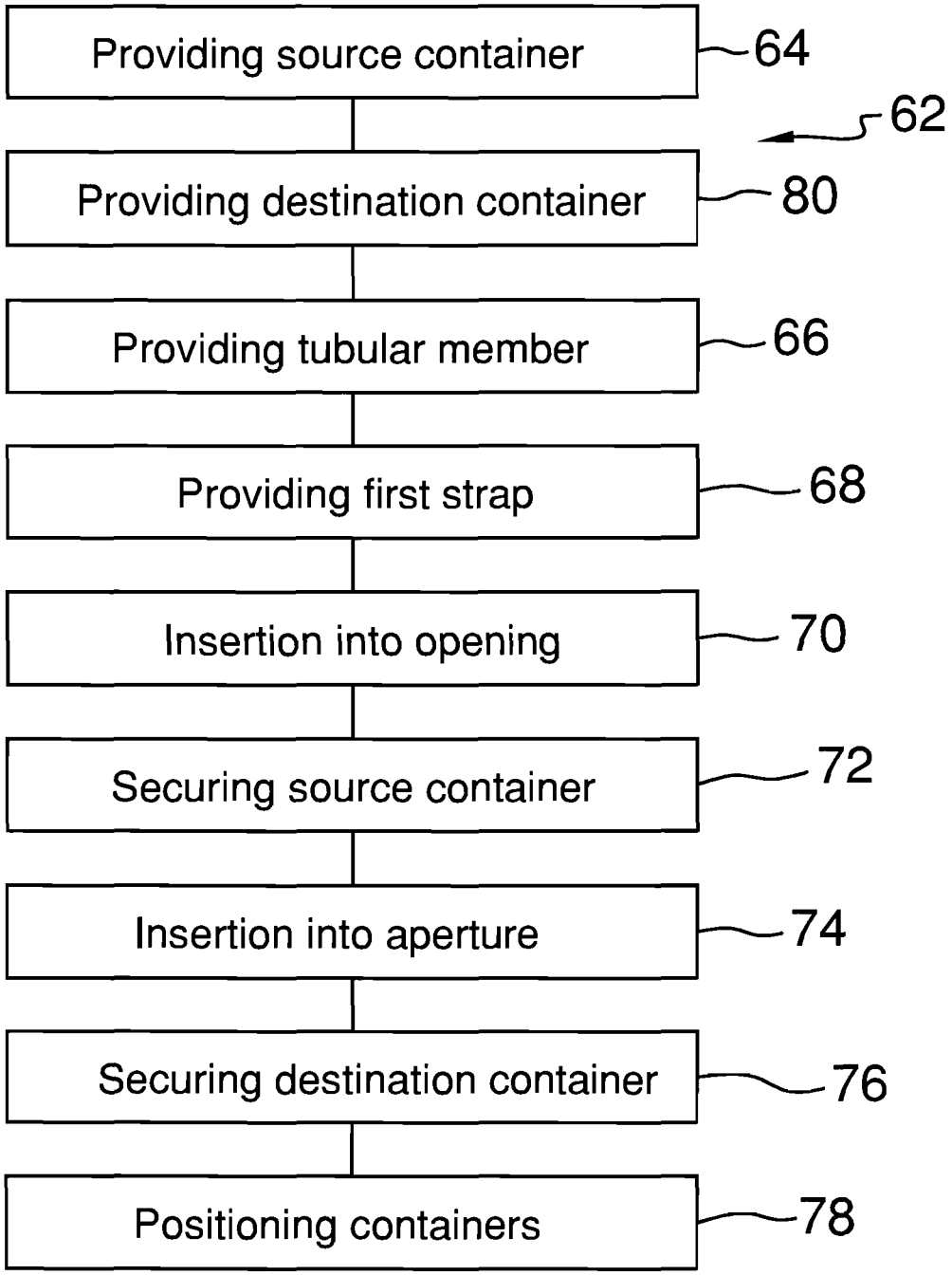
FIG. 7 is a schematic diagram of a method according to an embodiment of the disclosure.

With reference now to the drawings, and in particular to FIGS. 1 through 7 thereof, a new funnel device embodying the principles and concepts of an embodiment of the disclosure and generally designated by the reference numeral 10 will be described.

As best illustrated in FIGS. 1 through 7, the granular filler transfer device 10 generally comprises a tubular member 12 having a first end portion 14, a second end portion 16, and a medial portion 18 extending between the first end portion 14 and the second end portion 16. The first end portion 14 flares outwardly when approaching a first end 20 of the tubular member 12. The second end portion 16 flares outwardly when approaching a second end 22 of the tubular member 12. The medial portion of the tubular member may be cylindrical, stiff, and have a continuous cross-sectional shape 24 extending between the first end portion 14 and the second end portion 16.

A first strap 26 is removably coupled to the tubular member 12 proximate the first end portion 14. The first strap 26 is configured for securing around an opening 28 of a source container 30, such as a bean bag type piece of furniture, holding a quantity of granular filler material 32 such as foam pellets or the like. Thus, the medial portion 18 of the tubular member 12 is in fluid communication with an interior space 34 of the source container 30. The first strap 26 may be secured to the tubular member 12 using complimentary pieces of hook and loop fastener 36 coupled to the first strap 26.

Similarly, a second strap 38 is coupled to the medial portion 18 of the tubular member 12 proximate the second end portion 16. The second strap 38 is configured for securing around an aperture 40 of a destination container 42. Thus, the tubular member 12 is also in fluid communication with an interior space 44 of the destination container 42. The second strap 38 may be secured to the tubular member 12 using complimentary segments of hook and loop fastener 46 coupled to the second strap 38.

A spacing arm 48 may be utilized to maintain spacing between the first strap 26 and the second strap 38 during use. The spacing arm 48 has a first end 50 coupled to the first strap 26 and a second end 52 coupled to the second strap 38. The spacing arm 48 may have a first section 54 pivotally coupled to a second section 56 by a pin 58. The pin 58 may be inserted through a spacing member 60 positioned between the first section 54 and the second section 56.

In use, the device 10 provides for a method 62 of transferring the granular filler material 32 between the source container 30 and the destination container 42. The method 62 particularly facilitates transfer between a flexible source container 30 and a flexible destination container 42 such as transfer of foam pellets between bean bag type furniture.

The steps of the method 62 include an initial step 64 of providing the source container 30 holding the granular filler material 32. Another step 80 is providing the destination container 42 having the aperture 40 into the interior space 44 of the destination container 42. Yet another step 66 is providing the tubular member 12 having the flared first end portion 14, the flared second end portion 16, and the medial portion 18 extending between the first end portion 14 and the second end portion 16. Still another step 68 is providing the first strap 26 and the second strap 38. Another step 70 is inserting the first end portion 14 into the opening 28 into the interior space 34 of the source container 30. A next step 72 is securing the source container 30 to the tubular member 12 by securing the first strap 26 to the tubular member 12 around the opening 28. A step 74 is inserting the second end portion 16 into the aperture 40 into the interior space 44 of the destination container 42. Yet another step 76 is securing the destination container 42 to the tubular member 12 by securing the second strap 38 to the tubular member 12 around the aperture 40. A final step 78 is positioning the source container 30 above the destination container 42 such that the opening 28 is aligned with the aperture 40 whereby the granular filler material 32 passes through the tubular member 12 from the interior space 34 of the source container 30 into the interior space 44 of the destination container 42.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure.

We claim:

1. A granular filler transfer device comprising:

a tubular member having a first end portion and a second end portion, said first end portion flaring outwardly approaching a first end of said tubular member, said second end portion flaring outwardly approaching a second end of said tubular member;

a first strap coupled to said tubular member proximate said first end portion, said first strap being configured for securing around an opening of a source container holding a quantity of granular filler material whereby said tubular member is in fluid communication with an interior of the source container;

a second strap coupled to said tubular member proximate said second end portion, said second strap being configured for securing around an aperture of a destination container whereby said tubular member is in fluid communication with an interior of the destination container; and a spacing arm having a first end coupled to said first strap and a second end coupled to said second strap.

2. The device of claim 1, further including said spacing arm having a first section and a second section, said first section of said spacing arm being pivotally coupled to said second section of said spacing arm.

3. The device of claim 1, further including a medial portion extending between said first end portion and said second end portion.

4. The device of claim 3, further including said medial portion of said tubular member being cylindrical.

5. The device of claim 3, further including said medial portion of said tubular member being stiff.

6. The device of claim 3, further including said medial portion of said tubular member having a continuous cross-sectional shape extending between said first end portion and said second end portion.

7. The device of claim 1, further including said first strap being secured to said tubular member using complimentary pieces of hook and loop fastener coupled to said first strap.

8. The device of claim 7, further including said second strap being secured to said tubular member using complimentary segments of hook and loop fastener coupled to said second strap.

9. A granular filler transfer device comprising:

a tubular member having a first end portion, a second end portion, and a medial portion extending between said first end portion and said second end portion, said first end portion flaring outwardly approaching a first end of said tubular member, said second end portion flaring outwardly approaching a second end of said tubular member, said medial portion of said tubular member being cylindrical, said medial portion of said tubular member being stiff, said medial portion of said tubular member having a continuous cross-sectional shape extending between said first end portion and said second end portion;

a first strap coupled to said tubular member proximate said first end portion, said first strap being configured for securing around an opening of a source container holding a quantity of granular filler material whereby said tubular member is in fluid communication with an interior of the source container, said first strap being secured to said tubular member using complimentary pieces of hook and loop fastener coupled to said first strap;

a second strap coupled to said tubular member proximate said second end portion, said second strap being configured for securing around an aperture of a destination container whereby said tubular member is in fluid communication with an interior of the destination container, said second strap being secured to said tubular member using complimentary segments of hook and loop fastener coupled to said second strap; and a spacing arm having a first end coupled to said first strap and a second end coupled to said second strap, said spacing arm having a first section and a second section, said first section of said spacing arm being pivotally coupled to said second section of said spacing arm.

* * * * *